United States Patent [19]

Dahl

[11] Patent Number: 4,857,894

[45] Date of Patent: Aug. 15, 1989

[54] LIQUID LEVEL MEASUREMENT SYSTEM FOR ANALOG AND DIGITAL READOUT

[75] Inventor: Ernest A. Dahl, Ventura, Calif.

[73] Assignee: The United States of America as represented by the Secretary of the Navy, Washington, D.C.

[21] Appl. No.: 213,032

[22] Filed: Jun. 27, 1988

[51] Int. Cl.[4] ..... G08B 21/00

[52] U.S. Cl. ..... 340/619; 73/293; 250/577

[58] Field of Search ..... 340/619, 618; 250/577; 307/118; 73/293

[56] References Cited

U.S. PATENT DOCUMENTS

| | | | |
|---|---|---|---|
| 2,233,297 | 2/1941 | Polin et al. | 340/620 X |
| 4,286,464 | 9/1981 | Tauber et al. | 340/619 X |
| 4,354,180 | 10/1982 | Harding | 340/619 |
| 4,713,552 | 12/1987 | Denis et al. | 73/293 X |

FOREIGN PATENT DOCUMENTS

| | | | |
|---|---|---|---|
| 32602 | 4/1934 | Netherlands | 73/54 |
| 1518492 | 7/1978 | United Kingdom | 340/619 |

*Primary Examiner*—Joseph A. Orsino
*Assistant Examiner*—Jeffery A. Hofsass
*Attorney, Agent, or Firm*—David S. Kalmbaugh

[57] ABSTRACT

An elongated level sensor system has an optical prism formation moulded or cut in a side, and includes a plurality of LED light sources and corresponding photocells positioned along its length. Light from the LED sources are reflected off the prism surfaces to respective photocells when there is no liquid present in the area, thereby indicating "no liquid media present." When liquid surrounds a particular section, light from the LED is not reflected from the prism surfaces, but is refracted out; the change in photocell voltage then indicates the presence of liquid media. The system can be used in a plurality of liquid storage areas, and read out simultaneously at a remote sensor/alarm panel.

4 Claims, 2 Drawing Sheets

LIQUID LEVEL MEASUREMENT SYSTEM FOR ANALOG AND DIGITAL READOUT

The invention described herein may be manufactured and used by or for the Government of the United States of America for governmental purposes without the payment of any royalties thereon or therefor.

FIELD OF INVENTION

The present invention relates to improvements in measuring and displaying the level of a liquid within a tank and particularly to a passive fluid quantity sensing system.

BACKGROUND OF THE INVENTION

Numerous devices and liquid level gauges have been devised for measuring and displaying the level of a liquid within a storage tank or reservoir. The prior art devices have involved sight gauges; electro-optical systems using light pipes, external and color lights, lenses, prisms and filters, and fiber optics; and are generally complex and expensive systems.

SUMMARY

The present invention is an improvement over prior art devices, uses no moving parts and provides a simpler and accurate liquid level measuring system that is less complicated, very reliable and less expensive than previous similar types of devices. The invention uses optical prisms or prismatic formations in a transparent plastic wall at discrete locations along the length of the measuring device in combination with photo micro sensors and circuitry for detecting liquid level by sensing blockage of light passage through the prism wall due to an index of refraction mismatch. Analog or digital readout of the appropriate liquid level is then indicated at the location of the device or at a remote location.

It is an object of the invention, therefore, to provide an improved liquid level measuring system which permits convenient remote detection of the level of a liquid media.

Another object of the invention is to provide an improved liquid level measuring system for indicating fluid level in a multiplicity of tanks or in irregular shaped tanks.

A further object of the invention is to provide an improved liquid level detector which has no moving parts.

The foregoing and other aspects will become apparent from the following detailed description of the invention when considered in conjunction with the accompanying drawings, wherein like numerals refer to like parts in different figures. It is to be expressly understood, however, that the drawings are not intended as a definition of the invention, but are for the purpose of illustration only.

DESCRIPTION OF THE PREFERRED EMBODIMENTS

Figures 1, 2, 3, 4:
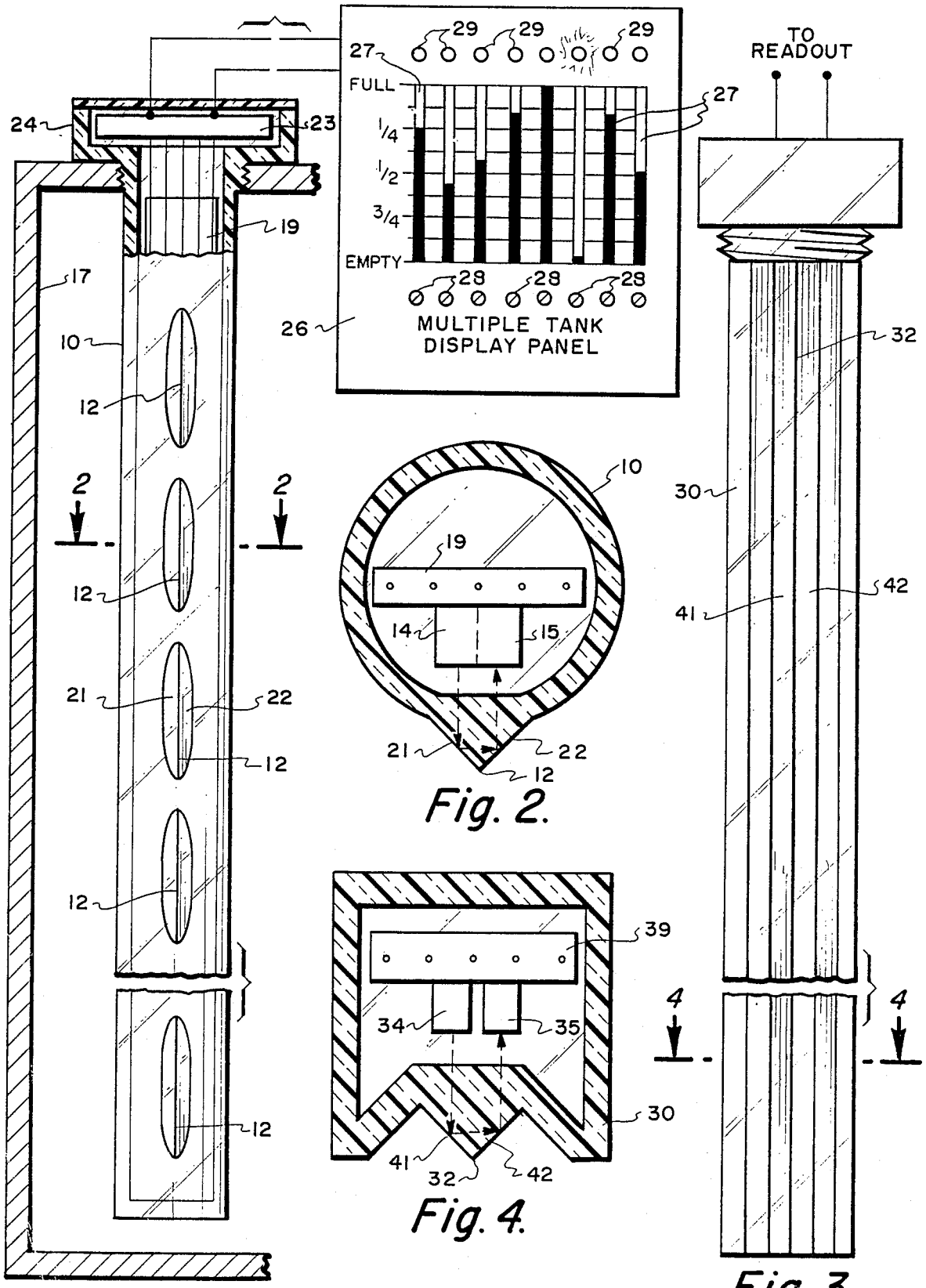
FIG. 1 is a vertical view of a preferred embodiment of the invention showing a tubular liquid level measurement device within a tank and a readout display panel.
FIG. 2 is an enlarged cross-sectional view taken along line 2—2 of FIG. 1.
FIG. 3 is a vertical view of another embodiment of the invention, similar to the device of FIG. 1.
FIG. 4 is an enlarged cross-sectional view taken along line 4—4 of FIG. 3.

Referring to FIGS. 1 and 2, the liquid level measurement system comprises a transparent tubular plastic housing 10, for example, having a plurality of transparent prismatic projections or formations 12 located along its vertical length. The prismatic formations 12 operate to reflect light from an LED cell 14 light source to a photodetector 15, both within housing 10, as shown in FIG. 2, to indicate loss of presence of liquid at a particular level, as hereinafter explained. An LED light source 14 and a corresponding photodetector cell 15 are positioned behind each of the respective prismatic formations. The transparent prismatic formations can be formed on or in the plastic housing 10 by any suitable technique, or mounted in openings in a housing of non-transparent material, although moulding or extruding them along with housing is preferrable for obvious reasons. Any suitable materials can be used to make the optical prismatic formations 12 and the housing 10. Housing 10 is shown mounted within a tank 17, by way of example, in FIG. 1, but the measuring device can be used in any reservoir or column of liquid to be measured.

The LED light source 14 and photodetector cell 15 may be mounted within housing 10 on a printed circuit board 19, for example, as shown in FIG. 2. If desired, a combination LED and photocell, such as Photo Micro Sensor, type EE-SMR-1-1, manufactured by OMRON, may be used for LED 14 and photodetector cell 15. Light from an LED source 14 to surface 21 will be reflected from the surface 21 to surface 22 of the prismatic formation 12, and then to the photodetector 15 due to index of refraction mismatch, for each respective detection level, when there is "no liquid" adjacent the outer surface of the prismatic formation in the area of the housing directly opposite a respective LED and corresponding photodetector. When liquid is present outside a prismatic formation, light from the respective LED will be refracted out, and not reflected from surfaces 21 and 22 back to its respective photodetector. Signals from the photodetector 15 are fed via conductors on circuit board 19, for example, to a hybrid communications circuit 23 mounted in the top 24 of housing 10. If preferred, communications hybrid circuit 23 can located on circuit board 19 or outside the housing at a remote location. Any form of light source can be used at 14 that will be reflected by the prismatic formation 12 and sensed by a photodetector 15.

Communications circuit 23 uses transponder type circuitry, for example, for monitoring a plurality of sensors or parameters on a simple two wire bus, such as the sensor circuitry disclosed in U.S. Pat. No. 4,217,645 by George H. Barry and Ernest A. Dahl for BATTERY MONITORING SYSTEM, issued Aug. 12, 1980. Information from communications circuit 23 may then be fed on a two wire communication line to an external readout at the top of housing 10 or at a remote location, such as an indicator panel 26, for example, as shown in FIG. 1. Readout panel 26, as shown, is comprised of a plurality of standard liquid crystal bar graphs 27, for example, to indicate the liquid level within respective tanks, with adjustment controls 28 and alarm lights or indicators 29. Indicators 29 are usually set to provide an alarm when a critical level is reached within a storage tank, and adjustment controls 28 can be used to set the critical level. Communications circuit 23 can be included in the indicator panel 26 for convenience, if desired. Standard d.c. type readout meters and alarms may also be used at display panel 26, however this would require more multiple wire conductors.

A modification of the device of FIGS. 1 and 2 is illustrated in FIGS. 3 and 4. In this embodiment a substantially rectangular or square cross-sectional tube shaped housing 30 is used. One surface of the housing tube has continuous grooves formed along the vertical length of the housing, as shown in FIG. 4 for example, defining a prismatic formation 32 which operates and performs the same function as the prismatic formations 12 of FIGS. 1 and 2. A single continuous prismatic formation 32 will permit the placement of a plurality of respective LED light sources 34 and photodetectors 35 mounted on circuit board 39 at any desired increment along the housing length for detecting liquid level. If desired, the prismatic formations 12 of FIGS. 1 and 2 can also be made as one continuous formation along the vertical length of housing 10. The modification shown in FIGS. 3 and 4 operates in the same manner as that of the device shown in FIGS. 1 and 2 with light from an LED 34 reflecting from surfaces 41 and 42 to a corresponding photodetector 35, and signals indicating liquid level are fed via circuit board 39 to a hybrid communications circuit, located in the top of housing 30, for example, and then to an external readout.

Figure 5:
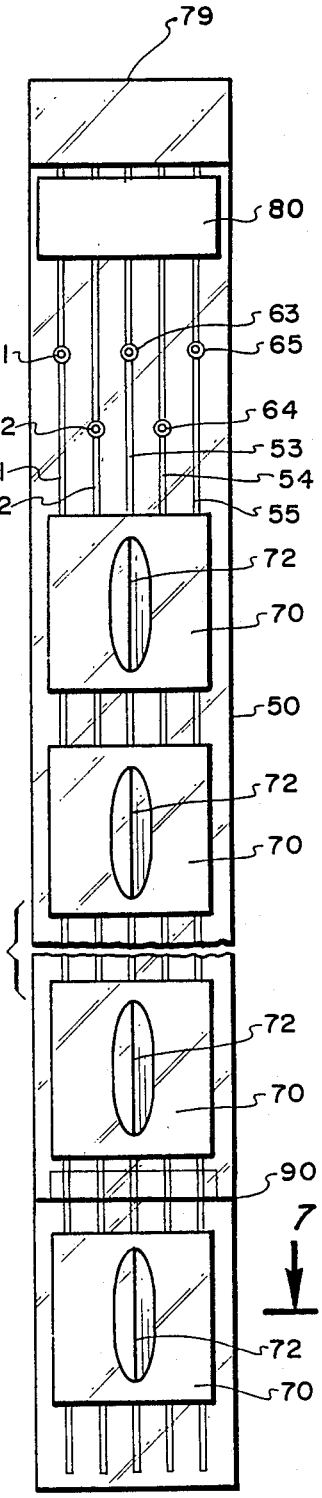
FIG. 5 is a front elevational view of still another embodiment of the invention showing a flexible strip liquid level detector system with selectively positioned detector modules.
Figure 6:
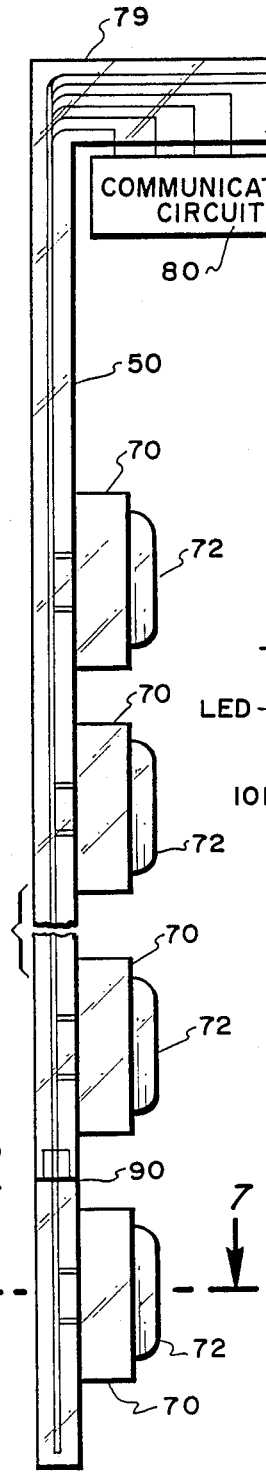
FIG. 6 is a side elevational view of the device shown in FIG. 5 with modules plugged into a mother board type strip.
Figure 7:
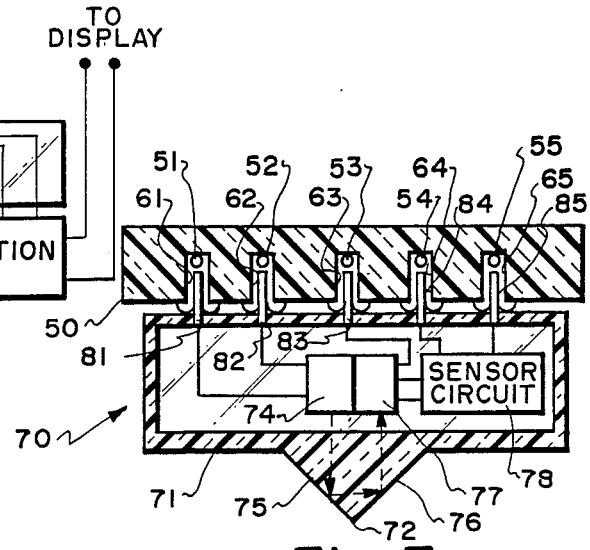
FIG. 7 is an enlarged cross-sectional view taken along line 7—7 of FIG. 6 showing details of a module plugged into a mother board strip.

A somewhat different type of construction for the liquid level measurement system is shown in FIGS. 5, 6 and 7 where a sealed printed circuit board type of construction is used. In this embodiment, as illustrated, an elongated transparent plastic laminate slat 50, similar to printed circuit board, includes a plurality of conductors, such as 51, 52, 53, 54 and 55, for example, encased within the laminate structure along its vertical length. Respective female type plug connectors 61, 62, 62, 64 and 65 are electrically attached to conductors 51, 52, 53, 54 and 55 mounted at incremental positions along the surface of the laminate 50 length to permit connection with detector modules 70 at various desired locations for measuring the level of a liquid media.

Detector modules 70 comprise a case 71, of any suitable material, but having at least a transparent prismatic window 72, as shown best in FIG. 7, for example, which is similar to the prismatic formations 12 of FIGS. 1 and 2. If desired, a prismatic formation as in FIG. 4 can be used, or other similar prism arrangement. Prism window arrangement 72 operates in the same manner as that of the device shown in FIGS. 1 and 2 with light from an LED 74 reflecting from surfaces 75 and 76 to photodetector 77, and signals from photodetector 77 and sensor circuitry 78, which sense liquid level, fed via conductors 54 and 55, for example, to the top 79 of the device where a hybrid communications circuit 80 can be connected. Male type connector pins 81, 82, 83, 84 and 85, for example, from modules 70 plug into female plug receptacles 61, 62, 63, 64 and 65, respectively. Information from the hybrid communications circuit is then be transmitted to a readout display panel, similar to panel 26 of FIG. 1. for external readout of the liquid level in a tank or multiplicity of tanks.

Elongated plastic laminate slat probe strip 50 can be made in sections, if desired, in order to lengthen the measuring device if needed for larger depth or irregular shaped tanks, tanks with insufficient headroom, reservoirs, etc., as well as to provide ease in storage of a long probe. Break 90, shown in FIGS. 5 and 6, signifies the connection of two sections of plastic laminate slats 50, which can be fastened together by any suitable well-known means. The laminate slat strips 50, which include wiring circuitry, are plugged and/or fastened together as needed to make up an extra long measuring gauge.

Figure 8:
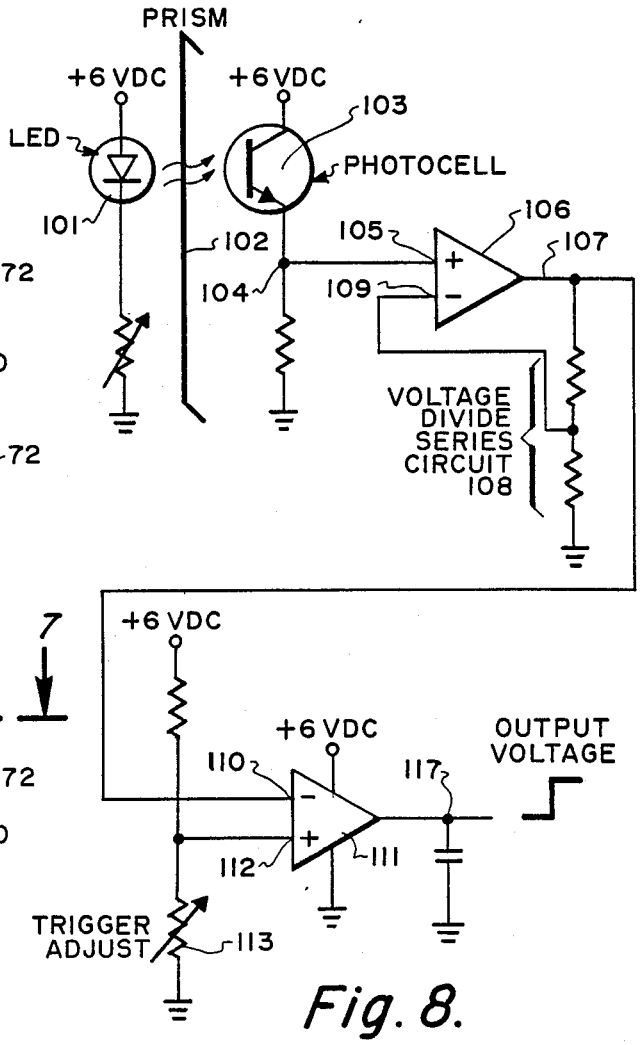
FIG. 8 is a circuit diagram illustrating the operation of indicator circuitry of the liquid level detection system of the present invention.

When light from an LED, 14 or 34 or 74, in FIGS. 2, 4 or 7 for example, is reflected to its respective photodetector 15 or 35 or 77, the respective sensor circuits provide signals which indicate the absence of liguid at that point along the measuring device. Referring to FIG. 8, the system, in general, operates as follows: Light from LED 101, in the circuit schematic, reflected from prism 102 to photodetector cell 103 results in a digital voltage at node voltage connection 104 which is applied to the positive input 105 of high impedance integrated circuit amplifier 106. As the voltage appears at the amplifier output 107, it is fed back through voltage divide resistors series circuit 108, where it is applied to the negative input 109 of amplifier 106. The two inputs are equal at all times. It is this ratio between the resistors which fixes the stage gain.

Voltage from output 107 of amplifier 106 is, in turn, applied to the negative input 110 of a Schmitt trigger amplifier 111. A trigger voltage adjustment is applied to the positive input terminal 112 of the Schmitt trigger amplifier by means of a variable resistor 113, for example. With liquid media removed from the area of prism 102, a trigger adjustment is made which places the negative input terminal 110 of amplifier 111 at a higher voltage level than the positive input terminal 112, resulting in 0 volts d.c. at output 117. As liquid media reaches the area of prism 102, light from LED 101 is refracted out through the prism and not reflected to photodetector 102. This has the effect of lowering the voltage at the negative input terminal 110 to amplifier 111 to the point of the trigger threshold. When the trigger threshold is passed, the output at 117 will trigger up to +6 volts d.c., for example, and be recorded as a digital voltage output indicating the presence of liquid media.

Obviously many modifications and variations of the present invention are possible in the light of the above teachings. It is therefore to be understood that within the scope of the appended claims, the invention may be practiced otherwise than as specifically described.

What is claimed is:

1. An improved liquid level indicating system for measuring the liquid level within a tank, comprising:

a. a transparent tubular plastic housing;

b. a plurality of transparent prismatic formations located along the vertical length of and extending from said housing such that said prismatic formations are made a part of one continuous formation along the vertical length of said housing;

c. a plurality of LED cells and a plurality of corresponding photodetectors located along the vertical length of said housing;

d. each of said LED cells and corresponding photodetector being positioned opposite one of said prismatic formations; each of said prismatic formations having two outer surfaces thereof exposed to the liquid to be measured;

e. each of said prismatic formations being operable to reflect light therewithin from said LED cell positioned opposite said prismatic formation to said corresponding photodetector when said liquid media being measured is absent from the outer surfaces of said prismatic formation positioned opposite said LED cell and said corresponding photodetector, and light from said LED cell being refracted out into said liquid media and not reflected to said photodetector when said liquid media is present at a measured location;

f. a plurality of electrical conductors located within said housing;

g. a signal voltage from each of said photodetectors being fed via one of said plurality of electrical conductors to one of a plurality of sensor circuits mounted in the top of said housing; said respective sensor circuit being operable to provide a signal indicative of the presence of said liquid media;

h. a liquid crystal bar graph having a plurality of inputs, each input of said bar graph being connected to the output of one of said plurality of sensor circuits; and i. said bar graph operable to indicate the liquid level within said tank in response to the signals from said sensor circuits indicative of the presence of said liquid media within said tank.

2. The improved liquid level measuring system of claim 1 wherein each of said circuits comprises:

a. a high impedance integrated circuit amplifier having a positive input connected to the output of said photodetector, a negative input and output;

b. a voltage divider resistive series circuit having an input connected to the output of said amplifier and an output connected to the negative input of said amplifier; and c. a Schmitt trigger having a negative input connected to the output of said amplifier, a positive input and an output connected to one of the plurality of inputs of said said bar graph.

3. The improved liquid level measuring system of claim further characterized by a printed circuit board mounted within said housing, said printed circuit board having mounted thereon said LED cells and said photodetectors.

4. The improved liquid level measuring system of claim 1 further characterized by an alarm light electrically connected to said bar graph for indicating critical liquid levels.

* * * * *